US007843142B2

(12) United States Patent
Kim et al.

(10) Patent No.: US 7,843,142 B2
(45) Date of Patent: Nov. 30, 2010

(54) PULSE WIDTH MODULATION APPARATUS AND APPARATUS FOR DRIVING LIGHT SOURCE HAVING THE SAME

(75) Inventors: Taek Soo Kim, Gwangju (KR); Hyun Sik Kim, Gwangju (KR)

(73) Assignee: LG Innotek Co., Ltd., Seoul (KR)

( * ) Notice: Subject to any disclaimer, the term of this patent is extended or adjusted under 35 U.S.C. 154(b) by 394 days.

(21) Appl. No.: 11/997,493

(22) PCT Filed: Apr. 17, 2007

(86) PCT No.: PCT/KR2007/001856

§ 371 (c)(1),
(2), (4) Date: Jan. 31, 2008

(87) PCT Pub. No.: WO2007/120001

PCT Pub. Date: Oct. 25, 2007

(65) Prior Publication Data

US 2008/0278087 A1 Nov. 13, 2008

(30) Foreign Application Priority Data

Apr. 18, 2006 (KR) ..... 10-2006-0034982

(51) Int. Cl.
*H05B 41/16* (2006.01)

(52) U.S. Cl. ..... 315/275; 315/224; 315/209 R; 315/194; 315/291

(58) Field of Classification Search ..... 315/173, 315/224, 225, 209 R, 185 S, 187, 194–199, 315/227 R, 237, 238, 241 R, 275
See application file for complete search history.

(56) References Cited

U.S. PATENT DOCUMENTS

| | | | | |
|---|---|---|---|---|
| 5,365,150 | A | 11/1994 | Shiomi et al. | |
| 6,486,616 | B1 | 11/2002 | Liu et al. | |
| 2003/0057864 | A1 * | 3/2003 | Smith | 315/209 R |
| 2004/0056825 | A1 | 3/2004 | Min et al. | |
| 2005/0067983 | A1 * | 3/2005 | Krieger et al. | 315/295 |

FOREIGN PATENT DOCUMENTS

KR 10-2002-0017358 A 3/2002

* cited by examiner

*Primary Examiner*—Tuyet Thi Vo
(74) *Attorney, Agent, or Firm*—Saliwanchik, Lloyd & Saliwanchik

(57) ABSTRACT

Provided are a pulse width modulation (PWM) apparatus and a light source-driving apparatus including the PWM apparatus. The PWM apparatus includes a voltage division part, a capacitor part, a first operational amplifier, a first noise reduction part, and a second operational amplifier. The voltage division part divides and outputs an input voltage. The capacitor part charged by an input current or discharged for provides a charge voltage. The first operational amplifier operates according to a result of comparing a divided voltage output from the voltage division part with the charge voltage output from the capacitor part. The first noise reduction part removes a high frequency noise of the divided voltage. The second operational amplifier converts a signal generated from the capacitor part into a pulse width modulation signal by a dimming control signal.

20 Claims, 3 Drawing Sheets

[Fig. 1]
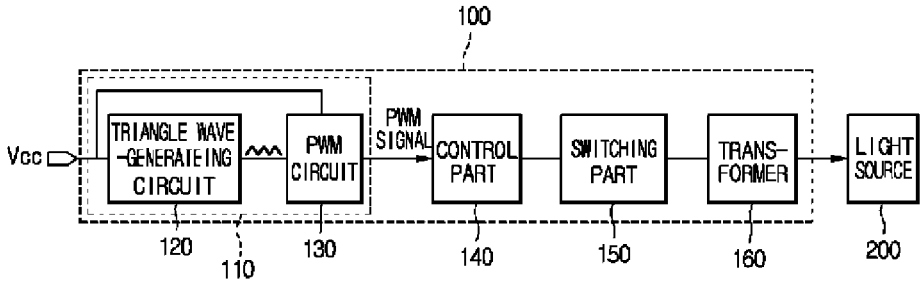
[Fig. 2]
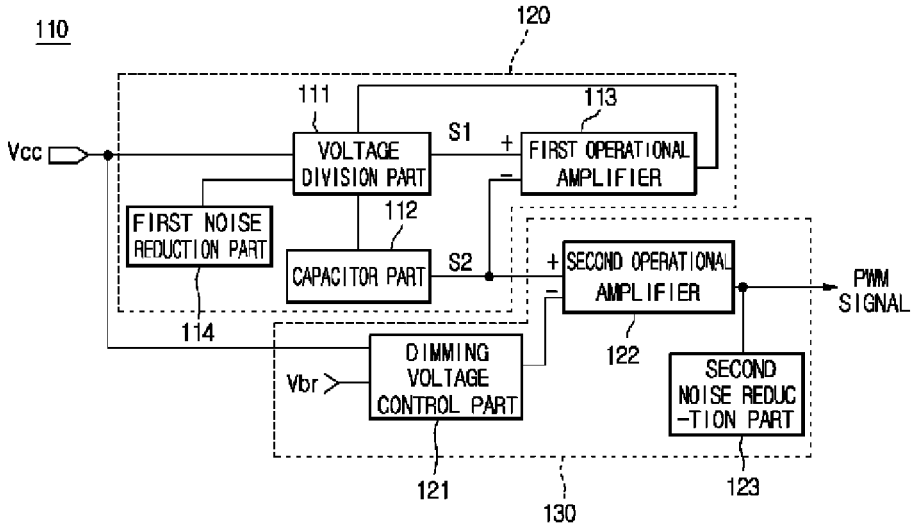
[Fig. 3]
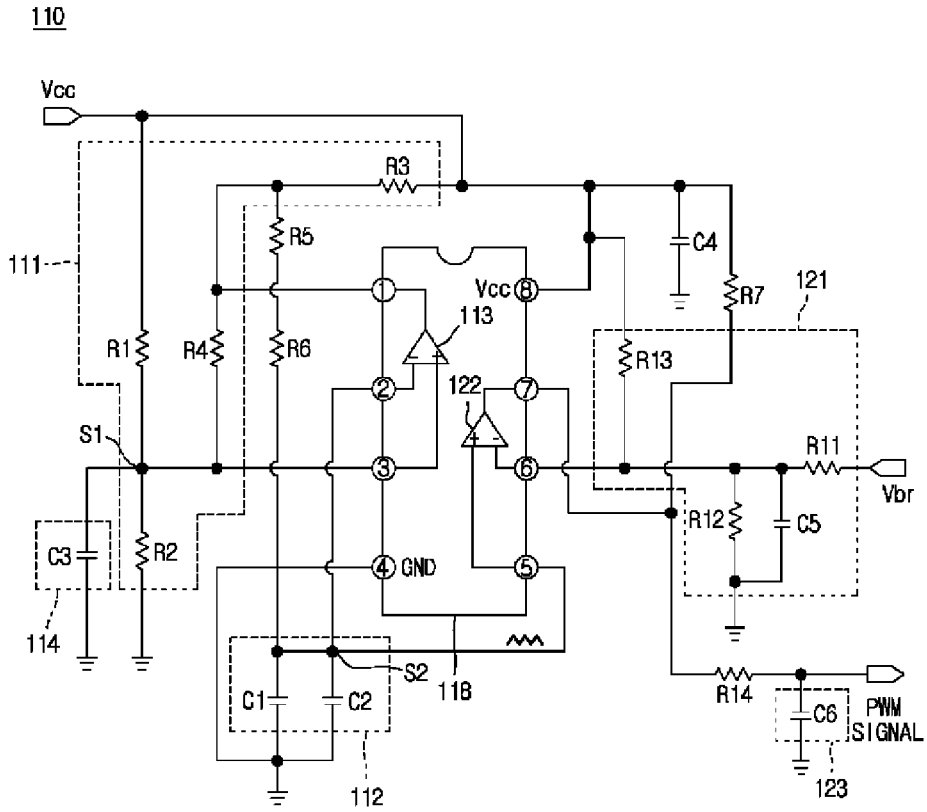

[Fig. 4]
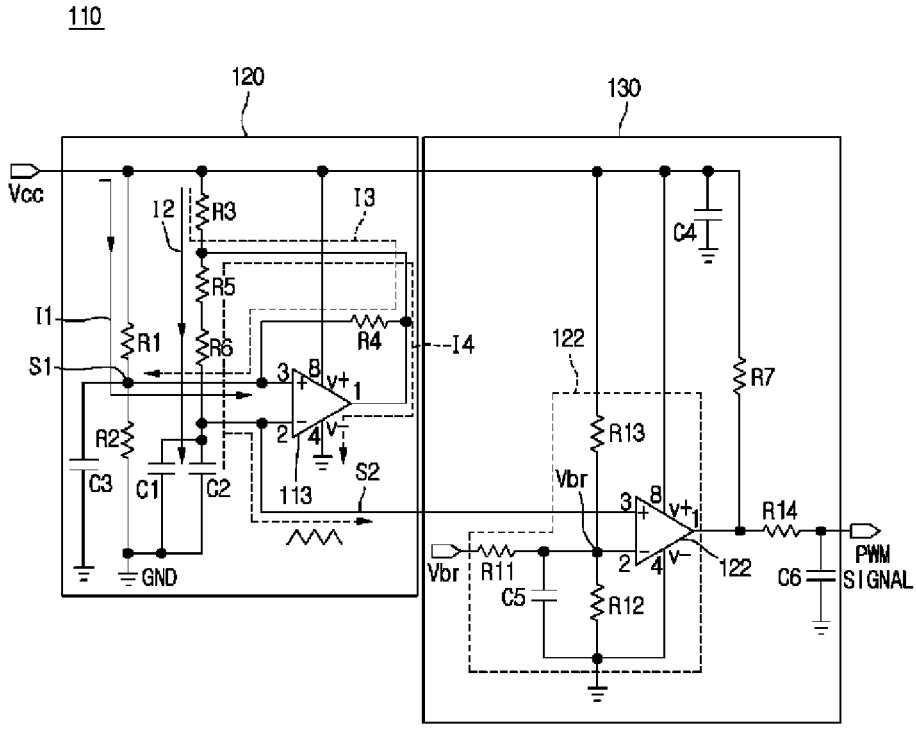
[Fig. 5]
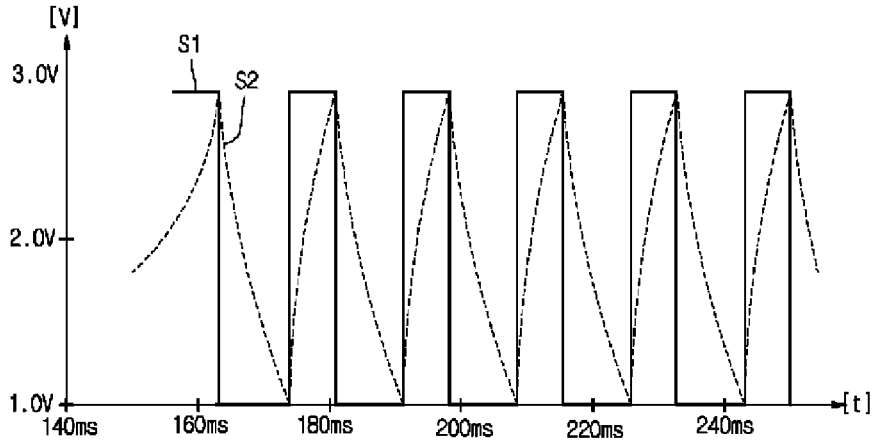
[Fig. 6]
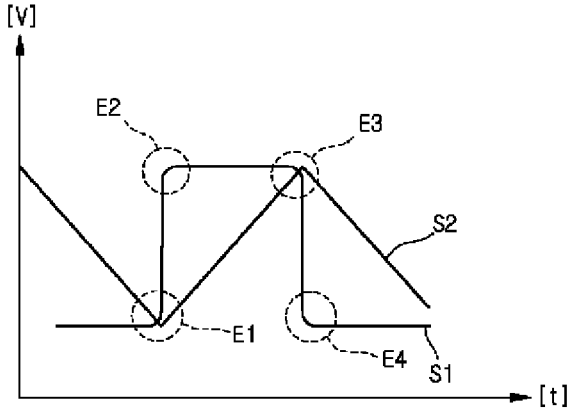

[Fig. 7]
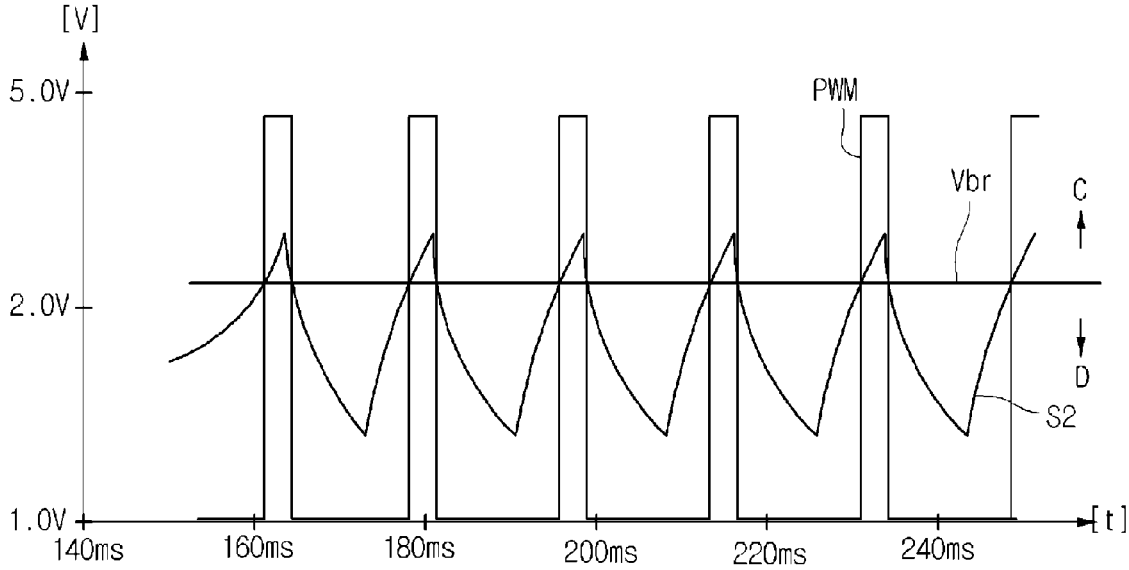
[Fig. 8]
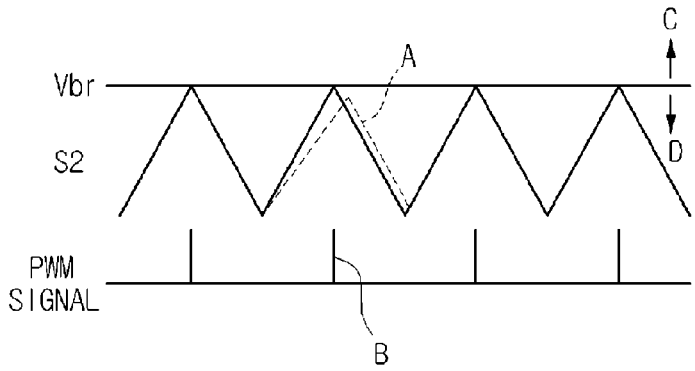

PULSE WIDTH MODULATION APPARATUS AND APPARATUS FOR DRIVING LIGHT SOURCE HAVING THE SAME

CROSS-REFERENCE TO RELATED APPLICATION

This application is the U.S. national stage application of International Patent Application No. PCT/KR2007/001856, filed Apr. 17, 2007, the disclosure of which is hereby incorporated by reference in its entirety.

TECHNICAL FIELD

Embodiments relate to a pulse width modulation apparatus and a light source-driving apparatus including the pulse width modulation apparatus.

BACKGROUND ART

A cold cathode fluorescent lamp (CCFL), an external electrode fluorescent lamp (EEFL), a light emitting diode (LED) may be used as a light source of a liquid crystal display (LCD) panel.

A light source such as aCCFL and an EEFL is driven using an inverter circuit. The inverter circuit converts direct current (DC) voltage to alternating current (AC) voltage, and then raises the AC voltage to several hundreds of volts to supply the high alternating current voltage to the lamp.

The inverter circuit can adjust brightness of a panel such as an LCD panel using a dimming function. That is, a triangle signal generated in the inverter circuit is converted into a pulse width modulation (PWM) signal by a dimming control signal.

However, the PWM signal may be distorted or inconstantly generated due to noises of the inverter circuit or a deviation of an integrated circuit (IC). Therefore, an output of the inverter circuit is affected to result in flicker phenomenon such as a picture shake on an LCD panel.

DISCLOSURE OF INVENTION

Technical Problem

An embodiment provides a pulse width modulation (PWM) apparatus removing a high frequency noise mixed in input direct current (DC) voltage and a light source-driving apparatus including the pulse width modulation apparatus.

An embodiment provides a pulse width modulation apparatus removing a high frequency noise mixed in input direct current voltage and a PWM signal and a light source-driving apparatus including the pulse width modulation apparatus.

An embodiment provides a PWM apparatus preventing flicker phenomenon on an LCD panel by removing a high frequency noise mixed in input direct current (DC) voltage and a light source-driving apparatus including the PWM apparatus.

Technical Solution

An embodiment provides a pulse width modulation apparatus comprising a voltage division part dividing to output an input voltage, a capacitor part charged or discharged by an input current for providing a charge voltage, a first operational amplifier operating according to a result of comparing a divided voltage output from the voltage division part with the charge voltage output from the capacitor part, a first noise reduction part removing a high frequency noise of the divided voltage, and a second operational amplifier converting a signal generated from the capacitor part into a pulse width modulation signal by a dimming control signal.

An embodiment provides a pulse width modulation apparatus comprising a triangle wave-generating circuit outputting a triangle wave signal by comparing a first voltage with a second voltage of a charged capacitor part, the first voltage being generated by removing a high frequency noise from an input voltage, and a pulse width modulation circuit converting the triangle wave signal output from the triangle wave-generating circuit into a pulse width modulation signal according to a dimming control signal.

An embodiment provides a light source-driving apparatus comprising a pulse width modulation part including a triangle wave-generating circuit outputting a triangle wave signal by comparing a square wave pulse without a high frequency noise with a charged reference voltage, and a pulse width modulation circuit converting the triangle wave signal output from the triangle wave-generating circuit into a pulse width modulation signal according to a dimming control signal, a control part outputting a control signal for controlling a light source according to the pulse width modulation signal, and a switching part converting input power into alternating current power according to the control signal of the control part.

Advantageous Effects

A pulse width modulation (PWM) apparatus and a light source-driving apparatus including the PWM apparatus according to an embodiment stably supply a PWM signal to stabilize a system and improve a reliability of a product.

In addition, a PWM apparatus and a light source-driving apparatus including the PWM apparatus according to an embodiment controls a duty ratio of a PWM signal within the whole range.

In addition, a PWM apparatus and a light source-driving apparatus including the PWM apparatus according to an embodiment prevents flicker phenomenon on an LCD panel.

BRIEF DESCRIPTION OF THE DRAWINGS

FIG. 1 is a diagram illustrating a light source-driving apparatus according to an embodiment;

FIG. 2 is a block diagram illustrating a pulse width modulation part of FIG. 1;

FIG. 3 is a circuit diagram illustrating the pulse width modulation part illustrated in FIG. 2;

FIG. 4 is a circuit diagram for illustrating an operation of the circuit illustrated in FIG. 3;

FIG. 5 is a graph illustrating voltage waveforms of an inverting terminal and a non-inverting terminal of a first operational amplifier illustrated in FIG. 3;

FIG. 6 is a graph illustrating removing a high frequency noise from the pulse width modulation part depicted in FIG. 3;

FIG. 7 is a graph illustrating input and output waveforms of a second operational amplifier illustrated in FIG. 3; and FIG. 8 is a graph illustrating a pulse width modulation signal output corresponding to a triangle wave according to an embodiment.

BEST MODE FOR CARRYING OUT THE INVENTION

Hereinafter, embodiments will now be more fully described with reference to the accompanying drawing.

FIG. 1 is a diagram illustrating a light source-driving apparatus 100 according to an embodiment.

Referring to FIG. 1, the light source-driving apparatus 100 converts an input direct current (DC) power into alternating current (AC) power according to a pulse width modulation (PWM) signal. After that, the light source-driving the light source-driving apparatus 100 controls driving voltage supplied to a light source 200 to adjust on-off and brightness of the light source 200. In addition, the light source-driving apparatus 100 senses voltage related to current flowing through the light source 200 and controls the light source 200 on the basis of the sensed voltage.

In here, the light source 200 includes a plurality of fluorescent lamps such as a cold cathode fluorescent lamp and an external electrode fluorescent lamp. In addition, the light source 200 may include a plurality of light emitting diodes (LEDs). In addition, the light source 200 may include the fluorescent lamp and the LED.

The light source-driving apparatus 100 includes a PWM part 110, a control part 140, a switching part 150, and a transformer 160.

The PWM part 110 outputs a PWM signal. The control part 140 controls the current according to the PWM signal such that the current constantly flows through the light source 200. The switching part 150 converts an input voltage into an AC voltage corresponding a frequency using a control signal of the control part 140 and supplies the AC voltage to the transformer 160.

The transformer 160 raises the AC voltage supplied by the switching part 150 to a high voltage depending on a turns ratio and supply the high voltage to the light source 200. Therefore, the light source 200 is turned on. When the light source is an LED, the transformer 160 may be removed.

The control part 140 is an inverter control part. The control part 140 receives a current feedback flowing through the light source 200 and controls the switching part 150 such that the current constantly flows through the light source 200.

The PWM part 110 includes a triangle wave-generating circuit 120 and a PWM circuit 130. The triangle wave-generating circuit 120 removes a high frequency noise of a square wave pulse. After that, the triangle wave-generating circuit 120 compares the square wave pulse without the high frequency noise with a charge voltage, and thus generates a triangle wave signal having a constant period. An upper and lower vertex potentials of the triangle wave signal do not shake by removing the high frequency noise included in an edge of the square wave pulse.

The PWM circuit 130 converts the triangle wave signal into the PWM signal according to a dimming control signal. A duty ratio of the PWM signal varies according to a level of the dimming control signal.

In here, the dimming control signal varies according to up or down of a DC voltage. The duty ratio of the PWM signal varies by comparing a voltage level of the variable dimming control signal with the triangle wave. When the duty ratio is 100% dimming, voltage of the dimming control signal moves to a vertex of the triangle wave signal to result in 100% turn-on and 0% turn-off. A triangle wave signal having a constant vertex potential prevents the PWM signal from being distorted or inconstantly generated.

The light source-driving apparatus 100 according to the embodiment can control a light unit for a liquid crystal display device controlling the light source 200 such as the fluorescent lamp and the LED.

FIG. 2 is a block diagram illustrating the PWM part 110 according to an embodiment.

Referring to FIG. 2, the PWM part 110 includes the triangle wave-generating circuit 120 and the PWM circuit 130. The triangle wave-generating circuit 120 includes a voltage division part 111, a capacitor part 112, a first operational amplifier 113, and a first noise reduction part 114. The PWM circuit 130 includes a dimming voltage control part 121, a second operational amplifier 122, and a second noise reduction part 123.

An input DC voltage $V_{cc}$ and a feedback voltage are divided into a voltage S1. The voltage division part 111 outputs the voltage S1 to a non-inverting terminal (+) of the first operational amplifier 113 to change a reference voltage. A current input through the voltage division part 111 is charged or discharged by the capacitor part 112 connected to an inverting terminal (−) of the first operational amplifier 113. The capacitor part 112 outputs the triangle wave signal of which end points match a low level and a high level of the changed reference voltage of the non-inverting terminal (+) of the first operational amplifier 113. The capacitor part 112 performs a discharge operation when a voltage which is higher than the voltage S1 divided in the voltage division part 111 is charged. The capacitor part 112 performs a charge operation when a voltage which is lower than the divided voltage S1 is charged.

The first operational amplifier 113 compares the divided voltage S1 of the voltage division part 111 with a voltage S2 of the capacitor part 112 to operate in a low state or a high state. When the first operational amplifier 113 operates in a high state, a high voltage output from the first operational amplifier 113 is supplied to the voltage division part 111 through a feedback path. When the first operational amplifier 113 operates in a low state,an output terminal of the first operational amplifier 113 becomes a ground state.

The divided voltage S1 of the voltage division part 111 is supplied to the non-inverting terminal (+) of the first operational amplifier 113, in which a level of the divided voltage S1 is the square wave pulse according to a charge period or a discharge period of the capacitor part 112.

The first noise reduction part 114 removes a high frequency noise included in the voltage supplied to the voltage division part 111, that is, in the divided voltage S1 of the input voltage and the feed back voltage. In here, the high frequency noise is included in the feedback voltage because of a transistor included in the first operational amplifier 113, a parasitic capacitance, a delay of switching speed and the like. The high frequency noise is removed by the first noise reduction part 114.

The voltage S2 supplied to the first operational amplifier 113 is converted into the triangle wave signal through the charge and discharge operations of the capacitor part 112. The triangle wave signal is provided as an input voltage of a non-inverting terminal (+) of the second operational amplifier 122. The second operational amplifier 122 compares the triangle wave signal input to the non-inverting terminal (+) with the dimming control signal Vbr input to an inverting terminal (−) to output the PWM signal.

In here, the dimming control signal Vbr for a dimming control or a brightness control is a variable DC voltage provided from a set (e.g., control part).

The dimming voltage control part 121 adds a predetermined base voltage to the dimming control signal Vbr and outputs the dimming control signal Vbr including the predetermined base voltage to the inverting terminal (−) of the second operational amplifier 122. The dimming control part 121 raises the predetermined base voltage so as to extend a DC voltage range of the dimming control signal Vbr provided from the set. That is, for example, when the voltage of the dimming control signal Vbr provided from the set ranges from 0 V to 3 V, the base voltage ranging from 1 V to 2 V is added such that the dimming control signal Vbr ranging from 1 V to 5 V is supplied to the inverting terminal (−).

In here, the second operational amplifier 122 outputs the variable duty ratio of the PWM signal according to the variable level of the dimming control signal Vbr added to the predetermined triangle wave signal.

The second noise reduction part 123 is formed at an output end of the second operational amplifier 122. The second noise reduction part 123 removes a high frequency noise included in the PWM signal, and then the PWM signal is supplied to the control part 140. Therefore, the more accurate PWM signal is supplied to the control part 140.

FIG. 3 is a circuit diagram illustrating the PWM part 110 according to an embodiment. FIG. 4 is a circuit diagram illustrating operation of the circuit illustrated in FIG. 3;

Referring to FIGS. 3 and 4, the voltage division part 111 includes a first, second, third, and fourth resistors R1, R2, R3, and R4. The first noise reduction part 114 includes at least one third capacitor C3. The capacitor part 112 includes a first and second capacitors C1 and C2. The first and second operational amplifiers 113 and 122 may form an integrated circuit 118. The dimming voltage control part 121 includes a plurality of resistors R11, R12, and R13. The second noise reduction part 123 includes at least one sixth capacitor C6.

The voltage division part 111 divides the input DC voltage $V_{cc}$ and the feedback voltage into the divided voltage S1 using the first, second, third, and fourth resistors R1, R2, R3, and R4 and outputs the divided voltage S1 to the non-inverting terminal (+) of the first operational amplifier 113. In the voltage division part 111, the input DC voltage $V_{cc}$ is supplied to one end of the first resistor R1 and one end of the third resistor R3. The other end of the first resistor R1 is connected to the second resistor R2 and the third capacitor C3 which are grounded. The third capacitor C3 functions as the first noise reduction part 114.

One end of the first resistor R1 is connected to the third resistor R3. The fourth resistor R4 is between the other end of the first resistor R1 and the third resistor R3. In addition, the other end of the first resistor R1 is connected to the non-inverting terminal (+) of the first operational amplifier 113 through a third pin of the integrated circuit 118.

The output terminal of the first operational amplifier 113 is between the third and fourth resistors R3 and R4 to form the feedback path.

The inverting terminal (−) of the first operational amplifier 113 is connected to the capacitor part 112. In the capacitor part 112, the first capacitor C1 is parallel-connected to the second capacitor C2, and one end of the first and second capacitors C1 and C2 is connected to a ground terminal GND. One end of the first and second capacitors C1 and C2 is connected to the inverting terminal (−) of the first operational amplifier 113 through a second pin of the integrated circuit 118 and is connected to the non-inverting terminal (+) of the second operational amplifier 122 through a fifth pin of the integrated circuit 118.

The dimming control signal Vbr is input to the inverting terminal (−) of the second operational amplifier 122 through the dimming voltage control part 121. The dimming control signal Vbr is input to the inverting terminal (−) of the second operational amplifier 122 through a sixth pin of the integrated circuit 118 via an eleventh resistor R11 of the dimming voltage control part 121. One end of the eleventh resistor R11 is parallel-connected to a twelfth resistor R12, a fifth capacitor C5, and a thirteenth resistor R13 connected to the input DC voltage $V_{cc}$. The twelfth resistor R12 and the fifth capacitor C5 are grounded. The voltage of the dimming control signal is raised to a predetermined level by the input DC voltage $V_{cc}$ supplied to the thirteenth resistor R13.

An output terminal of the second operational amplifier 122 outputs the PWM signal through a fourteenth resistor R14 via a seventh pin of the integrated circuit 118.

In here, the sixth capacitor C6 of the second noise reduction part 123 removes the high frequency noise included in the PWM signal to stably send the PWM signal to the control part 140 illustrated in the FIG. 1.

Meanwhile, when the triangle wave-generating circuit 120 operates, the input DC voltage $V_{cc}$ is input to the first operational amplifier 113(I1), and the first operational amplifier 113 outputs the high voltage through the feedback path.

In here, the first and second capacitors C1 and C2 of the capacitor part 112 starts to charge using an input current from a zero state. The first and second capacitors C1 and C2 of the capacitor part 112 charges using the input current flowing through the third resistor R3, a fifth resistor R5, and a sixth resistor R6 (I2). The charge voltage S2 is provided as a reference voltage of the inverting terminal (−) of the first operational amplifier 113.

The input DC voltage $V_{cc}$ and the feedback voltage input the first and third resistors R1 and R3 are divided into the voltage S1 by a resistance R1//(R3+R4). The voltage S1 is supplied to the non-inverting terminal (+) of the first operational amplifier 113.

The first operational amplifier 113 compares the divided voltage S1 input to the non-inverting terminal (+) with the charge voltage S2 input to the inverting terminal (−). When the divided voltage S1 is greater than the charge voltage S2, the first operational amplifier 113 outputs a non-inverting amplified voltage. The high voltage output from the first operational amplifier 113 is input to the non-inverting terminal (+) through the fourth resistor R4.

In here, when a level of the charge voltage S2 is greater than that of the divided voltage S1, the output terminal of the first operational amplifier 113 is grounded. The charge voltage S2 of the first and second capacitors C1 and C2 is discharged through the ground terminal V—of the first operational amplifier 113 via the fifth and sixth resistors R5 and R6 (I4).

In here, although the capacitor part 112 includes the first and second capacitors C1 and C2 for a fine adjustment, one capacitor can be used.

When the level of the charge voltage S2 is greater than that of the divided voltage S1, the output terminal of the first operational amplifier 113 is the ground terminal V—to result in the discharge operation. In here the level of the divided voltage S1 (Low level) is determined by the first and second resistors R1 and R2. A current introduced into the third resistor R3 flows to a first and fourth pins, that is, the ground terminal V—of the first operational amplifier 113. When the first and second capacitors C1 and C2 are discharged, the voltage S2 of the inverting terminal (−) of the first operational amplifier 113 is lower than the divided voltage S1 of the non-inverting terminal (+) using the first and second resistors R1 and R2. In here, the output terminal of the first operational amplifier 113 outputs the non-inverting amplified voltage. The level of the voltage S1 (High level) is determined by a parallel resistor [(R1//(R3+R4)] and the second resistor R2 and is greater than the low level determined by the first and second resistors R1 and R2. In here, the first and second capacitors C1 and C2 is not discharged any more through the output terminal of the first operational amplifier 113 and start to be recharged until when the level of the voltage S2 is greater than that of the divided voltage S1. When the voltage S2 of the inverting terminal (−) of the first operational amplifier 113 is greater than the divided voltage S1 of the non-inverting terminal (+), the output terminal of the first operational amplifier 113 is the ground terminal V—to result in the discharge operation. As described above, the first and second capacitors C1 and C2 are charged or discharged in turns.

In here, a node voltage of the inverting terminal (−) of the first operational amplifier 113 is determined by a parallel resistor R4//R1//R2. When the level of the voltage S2 of the first and second capacitors C1 and C2 which are charged is lower than that of the divided voltage S1, the output terminal of the first operational amplifier 113, that is, the first and fourth pins are opened (When the first operational amplifier 113 is opened, the high voltage of output terminal of the first operational amplifier 113 is affected by the third and fourth resistors R3 and R4). The first operational amplifier 113 converts the divided voltage S1 input to the non-inverting terminal (+) into the non-inverting amplified voltage.

In here, the high frequency noise of the divided voltage S1 is removed by the third capacitor C3 of the first noise reduction part 114. That is, as illustrated in FIG. 6, noises of rising and falling edges E1, E2, E3, and E4 of a square wave pulse are removed, so that each edge is rounded.

As described above, referring to FIG. 5, the divided voltage S1 is input to the non-inverting terminal (+) of the first operational amplifier 113 in a period of the square wave pulse. The triangle wave signal is input to the non-inverting terminal (+) of the second operational amplifier 122 by the charge and discharge operations of the capacitor part 112. The period of the triangle wave pulse can be adjusted according to the size of a division resistor and/or the capacitance of a capacitor.

As described above, the first operational amplifier 113 operates in an open-collector mode in which the output terminal is opened or grounded by comparing the divided voltage S1 input to the non-inverting terminal (+) with the voltage S2 input to the inverting terminal (−). That is, the first operational amplifier 113 is an open-collector. When the voltage S2 of the inverting terminal (−) is greater than the divided voltage S1 of the non-inverting terminal (+), the output terminal is the ground. When the divided voltage S1 of the non-inverting terminal (+) is greater than the voltage S2 of the inverting terminal (−), the output terminal is opened.

The triangle signal of the voltage S2 is input to the non-inverting terminal (+) of the second operational amplifier 122 according to the charge period or the discharge period of the capacitor part 112.

Referring to FIG. 7, the triangle signal of the voltage S2 input to the non-inverting terminal (+) of the second operational amplifier 122 is converted into the PWM signal by the dimming control signal Vbr. The dimming control signal Vbr is a voltage input to the inverting terminal (−) of the second operational amplifier 122, which includes the base voltage added by the dimming voltage control part 121.

The dimming control signal Vbr having a predetermined DC voltage level using the eleventh, twelfth, and thirteenth resistors R11, R12, and R13 of the dimming voltage control part 121 is input to the inverting terminal (−) of the second operational amplifier 122.

The dimming control signal Vbr input to the inverting terminal (−) of the second operational amplifier 122 is compared with the triangle signal input to the non-inverting terminal (+), and then the PWM signal is output according to a result of the comparison. In addition, when a voltage of the dimming control signal Vbr is raised and reduced, the duty ratio of the PWM signal is varied in correspondence with the varied voltage of the dimming control signal Vbr.

In here, when the dimming control signal Vbr input to the inverting terminal (−) of the second operational amplifier 122 is formed on an upper vertex of the triangle signal of the voltage S2 as illustrated in FIG. 8, the PWM signal is output.

In here, shaking phenomenon (portion A) of the triangle signal is removed by removing the high frequency noise of the square wave pulse generated in the triangle wave-generating circuit 120. Therefore, an output error of a PWM signal corresponding to the A triangle signal can be prevented.

In addition, the duty ratio of the PWM signal can be controlled within the whole range using the dimming control signal Vbr. Therefore, it is possible to easily control the light source 200 using the switching part 500. In addition, the flicker phenomenon of the LCD panel is prevented.

INDUSTRIAL APPLICABILITY

A pulse width modulation (PWM) apparatus and a light source-driving apparatus including the PWM apparatus according to an embodiment stably supply a PWM signal to stabilize a system and improve a reliability of a product.

In addition, a PWM apparatus and a light source-driving apparatus including the PWM apparatus according to an embodiment controls a duty ratio of a PWM signal within the whole range.

In addition, a PWM apparatus and a light source-driving apparatus including the PWM apparatus according to an embodiment prevents flicker phenomenon on an LCD panel.

A light source-driving apparatus according to an embodiment is provided to a light unit for a liquid crystal display device controlling a light source such as a fluorescent lamp and an LED.

The invention claimed is:

1. A pulse width modulation apparatus comprising:

a voltage division part dividing and outputting an input voltage;

a capacitor part charged by an input current or discharged for providing a charge voltage;

a first operational amplifier operating according to a result of comparing the divided voltage output from the voltage division part with the charge voltage output from the capacitor part;

a first noise reduction part removing a high frequency noise of the divided voltage; and a second operational amplifier converting a signal generated from the capacitor part into a pulse width modulation signal by a dimming control signal.

2. The pulse width modulation apparatus according to claim 1, wherein the voltage division part is connected to an output terminal of the first operational amplifier to form a feedback path.

3. The pulse width modulation apparatus according to claim 1, wherein the voltage division part supplies the divided voltage corresponding to a square wave pulse to the first operational amplifier according to whether the first operational amplifier is a high state or a low state.

4. The pulse width modulation apparatus according to claim 1, wherein the capacitor part is connected to an inverting terminal of the first operational amplifier and a non-inverting terminal of the second operational amplifier.

5. The pulse width modulation apparatus according to claim 1, wherein the capacitor part comprises at least one capacitor to output a triangle wave signal.

6. The pulse width modulation apparatus according to claim 1, wherein the first operational amplifier operates on an open-collector mode.

7. The pulse width modulation apparatus according to claim 1, wherein the first noise reduction part comprises at least one capacitor, one end of the capacitor being connected to the voltage division part, the other end of the capacitor being grounded.

8. The pulse width modulation apparatus according to claim 1, wherein the first noise reduction part makes an edge of the divided voltage output from the voltage division part rounded.

9. The pulse width modulation apparatus according to claim 1, comprising a second noise reduction part formed at an output terminal of the second operational amplifier, the second noise reduction part removing a high frequency noise from the pulse width modulation signal.

10. The pulse width modulation apparatus according to claim 9, wherein the second noise reduction part comprises at least one capacitor of which one end is grounded.

11. A pulse width modulation apparatus comprising:

a triangle wave-generating circuit outputting a triangle wave signal by comparing a first voltage with a second voltage of a charged capacitor part, the first voltage being generated by removing a high frequency noise from an input voltage of the triangle wave-generating circuit; and a pulse width modulation circuit converting the triangle wave signal output from the triangle wave-generating circuit into a pulse width modulation signal according to a dimming control signal.

12. The pulse width modulation apparatus according to claim 11, wherein the triangle wave-generating circuit comprises an operational amplifier, the first voltage is divided and input to a non-inverting terminal of the operational amplifier, and the second voltage is input to the inverting terminal of the operational amplifier.

13. The pulse width modulation apparatus according to claim 11, wherein the triangle wave-generating circuit comprises an operational amplifier, the triangle wave signal is input to a non-inverting terminal of the operational amplifier, and the dimming control signal is input to an inverting terminal of the operational amplifier.

14. The pulse width modulation apparatus according to claim 11, wherein the pulse width modulation circuit comprises a second noise reduction part removing a high frequency noise from the pulse width modulation signal.

15. The pulse width modulation apparatus according to claim 11, wherein the pulse width modulation circuit comprises a dimming voltage control part supplying a predetermined base voltage to a voltage of the dimming control signal.

16. A light source-driving apparatus comprising:

a pulse width modulation part including a triangle wave-generating circuit and a pulse width modulation circuit, the triangle wave-generating circuit outputting a triangle wave signal by comparing a square wave pulse without a high frequency noise to a charged reference voltage, the pulse width modulation circuit converting the triangle wave signal output from the triangle wave-generating circuit into a pulse width modulation signal according to a dimming control signal;

a control part outputting a control signal for controlling a light source according to the pulse width modulation signal; and a switching part converting input power into alternating current power according to the control signal of the control part.

17. The light source-driving apparatus according to claim 16, wherein the triangle wave-generating circuit comprises:

a voltage division part dividing an input voltage for converting the input voltage into a square wave pulse;

a capacitor part charged by an input current or discharged for providing the triangle wave signal;

a first operational amplifier operating according to a result of comparing the square wave pulse output from the voltage division part with a charge voltage output from the capacitor part; and a first noise reduction part removing the high frequency noise from the square wave pulse input to the first operational amplifier.

18. The light source-driving apparatus according to claim 17, wherein the pulse width modulation circuit comprises a second operational amplifier converting the triangle wave signal output from the capacitor part into the pulse width modulation signal according to the dimming control signal.

19. The light source-driving apparatus according to claim 17, comprising a transformer supplying a raised voltage to the light source using the alternating current power of the switching part, wherein the first noise reduction part includes at least one capacitor having one end connected to the voltage division part and the other end connected to the ground.

20. The light source-driving apparatus according to claim 18, comprising a second noise reduction part formed at an output terminal of the second operational amplifier, the second noise reduction part removing a high frequency noise from the pulse width modulation signal.

* * * * *